US009050516B2

(12) United States Patent
Holland et al.

(10) Patent No.: US 9,050,516 B2
(45) Date of Patent: Jun. 9, 2015

(54) SPRING-BACK BALL TEE FOR BATTING PRACTICE

(71) Applicant: Pro Performance Sports, L.L.C., Carlsbad, CA (US)

(72) Inventors: Allen Holland, Sheffield (GB); Kenneth Ollie Stark, San Marcos, CA (US)

(73) Assignee: PRO PERFORMANCE SPORTS, L.L.C., Carlsbad, CA (US)

( * ) Notice: Subject to any disclaimer, the term of this patent is extended or adjusted under 35 U.S.C. 154(b) by 136 days.

(21) Appl. No.: 13/855,859

(22) Filed: Apr. 3, 2013

(65) Prior Publication Data

US 2014/0302948 A1 Oct. 9, 2014

(51) Int. Cl.

| | |
|---|---|
| ***A63B 71/00*** | (2006.01) |
| ***A63B 69/00*** | (2006.01) |
| *A63B 71/02* | (2006.01) |

(52) U.S. Cl.

CPC ..... *A63B 69/0075* (2013.01); *A63B 69/0002* (2013.01); *A63B 2069/0008* (2013.01); *A63B 2243/0004* (2013.01); *A63B 71/023* (2013.01); *A63B 2210/50* (2013.01); *A63B 2225/093* (2013.01)

(58) Field of Classification Search

CPC ..... A63B 2069/0008; A63B 69/0002; A63B 2225/093; A63B 2069/401

USPC ..... 473/422, 417

See application file for complete search history.

(56) References Cited

U.S. PATENT DOCUMENTS

| | | | | |
|---|---|---|---|---|
| 2,272,765 | A | | 2/1942 | Dalton et al. |
| 2,616,692 | A | * | 11/1952 | Bird ..... 473/417 |
| 2,862,712 | A | * | 12/1958 | Delia et al. ..... 473/423 |
| 2,976,041 | A | | 3/1961 | White |
| 3,039,770 | A | | 6/1962 | Ferretti |
| 3,183,000 | A | | 5/1965 | Dix |
| 3,874,662 | A | | 4/1975 | Harrington |
| 3,877,697 | A | | 4/1975 | Lersch |
| 4,176,838 | A | | 12/1979 | Griffin |
| 4,227,691 | A | | 10/1980 | Lefebvre et al. |
| 4,364,563 | A | | 12/1982 | Stafford |
| 4,383,686 | A | | 5/1983 | Cardieri |
| 4,854,587 | A | | 8/1989 | Groves |
| 5,004,234 | A | | 4/1991 | Hollis |
| 5,386,987 | A | | 2/1995 | Rodino, Jr. |
| 5,386,988 | A | * | 2/1995 | Sung et al. ..... 473/423 |
| 5,393,050 | A | * | 2/1995 | Lloyd ..... 473/429 |
| 5,772,536 | A | | 6/1998 | Wang |
| 6,045,462 | A | | 4/2000 | Mourek |
| 6,146,289 | A | | 11/2000 | Miller et al. |
| 6,238,307 | B1 | | 5/2001 | Owen |
| 6,358,163 | B1 | | 3/2002 | Tanner |
| 6,398,671 | B1 | | 6/2002 | Rios |

(Continued)

*Primary Examiner* — Mitra Aryanpour

(74) *Attorney, Agent, or Firm* — Squire Patton Boggs (US) LLP

(57) ABSTRACT

A ball tee for batting practice has a base assembly including a base, a post cup pivotally attached to the base, and at least one spring biasing the post cup into an upright position. A post assembly has a lower end inserted into the post cup. The spring causes the post assembly to return to the upright position after the post assembly is struck and deflected by a bat. The base assembly may include a base plate, a spring bracket attached to the base plate, and an axle extending through the spring bracket, through the spring, and through an axle hole in the post cup. The post assembly may have two or more tubes that allow the height of the post assembly to be telescopically adjusted.

13 Claims, 7 Drawing Sheets

(56) References Cited

U.S. PATENT DOCUMENTS

| | | | | |
|---|---|---|---|---|
| 6,551,204 | B1 | 4/2003 | Di Re | |
| 6,616,554 | B2 | 9/2003 | Liao | |
| 7,204,769 | B2 | 4/2007 | Bandimere et al. | |
| 7,458,907 | B2 * | 12/2008 | Wang | 473/417 |
| 7,479,074 | B1 | 1/2009 | Pierce | |
| 7,704,168 | B1 | 4/2010 | Hochberg | |
| 7,775,912 | B2 * | 8/2010 | Aguirre | 473/423 |
| 8,109,844 | B1 * | 2/2012 | Quinn | 473/417 |
| 8,672,780 | B2 * | 3/2014 | Fournier | 473/417 |
| 2006/0035729 | A1 * | 2/2006 | Wang | 473/417 |
| 2006/0258485 | A1 | 11/2006 | Bandimere et al. | |
| 2006/0264273 | A1 | 11/2006 | Liao | |
| 2007/0049426 | A1 * | 3/2007 | Huang | 473/417 |
| 2008/0085787 | A1 | 4/2008 | Molloy et al. | |
| 2009/0029803 | A1 * | 1/2009 | Lincoln | 473/417 |
| 2009/0312123 | A1 | 12/2009 | Liao | |
| 2010/0056306 | A1 | 3/2010 | Chen | |
| 2010/0311524 | A1 | 12/2010 | Lay | |
| 2011/0092317 | A1 | 4/2011 | Burgess | |
| 2011/0136593 | A1 | 6/2011 | Keller et al. | |
| 2011/0183781 | A1 | 7/2011 | Chiu | |
| 2011/0183782 | A1 | 7/2011 | Wang | |
| 2011/0190079 | A1 | 8/2011 | Guevara | |
| 2011/0281671 | A1 * | 11/2011 | Chen | 473/417 |

* cited by examiner

FIG. 8
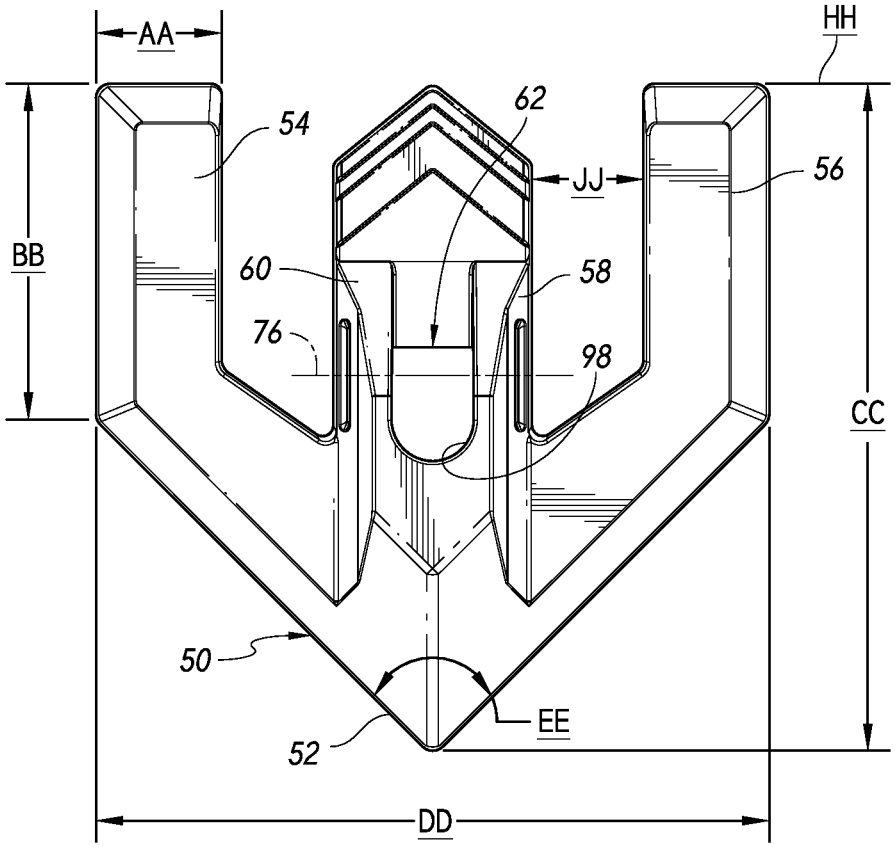
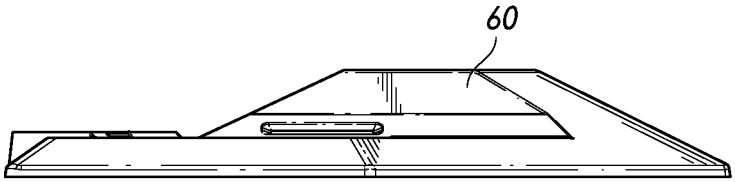
FIG. 9
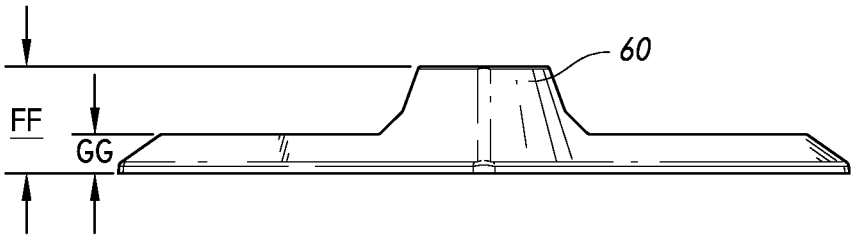
FIG. 10

SPRING-BACK BALL TEE FOR BATTING PRACTICE

BACKGROUND OF THE INVENTION

Batting tees are used by baseball players to practice hitting baseballs held at various positions within or near the strike zone. By using a batting tee to practice hitting a stationary ball, players can improve their batting swings and learn to hit balls from various locations within and near the strike zone. If the player swings the bat too low, as often happens, the bat hits the tee. The batting tee is consequently subjected to repeated impacts by the bat, which may damage the batting tee. The batting tee may also tip over when hit with a bat. This interrupts the batting practice since the user must then pick up and reset the batting tee. The batting tee should also be easily portable and quick to set up and take down. It should also be adjustable to hold the ball over a range of desired heights.

Various batting tees have been proposed in the past. Generally these batting tees have a flat base or plate, an adjustable length post on the plate, and a ball holder at the top end of the post. Examples are shown in U.S. Pat. No. 4,227,691, U.S. Pat. No. 5,386,987 and U.S. Pat. No. 6,358,163. While these and other designs may have met with varying degrees of success, certain disadvantages remain, including a tendency of batting tees to fall over, come apart, or sustain damage when hit with a bat. Accordingly, it is an object of the invention to provide an improved batting tee.

BRIEF DESCRIPTION OF THE DRAWINGS

In the drawings, the same element number indicates the same element in each of the views.

FIG. 8 is a plan view of the base shown in FIG. 7.

FIG. 9 is side view of the base shown in FIGS. 7 and 8.

FIG. 10 is a rear view of the base shown in FIGS. 7 and 8.

DETAILED DESCRIPTION OF THE DRAWINGS

Figure 1:
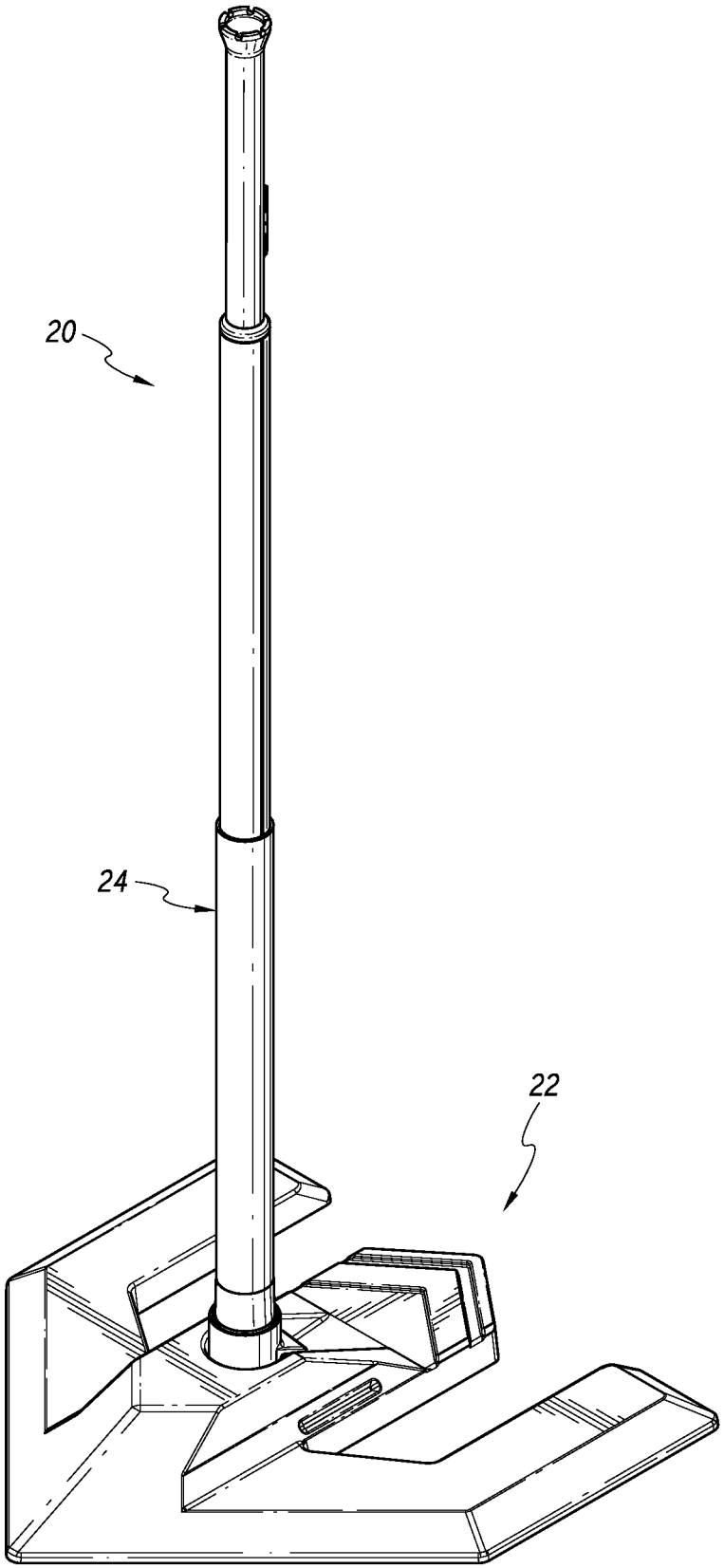
FIG. 1 is a perspective view of a new batting tee in use.

As shown in FIG. 1, a batting tee 20 may be provided as a post assembly 24 mountable onto a base assembly 22. The post assembly may be made up of one or more posts or tubes. In the example shown, the post assembly 24 has a lower tube 26, a middle tube 28 and an upper tube 30, as shown separately in FIGS. 2-4, respectively. One or more of the tubes, such as the lower tube 26 in FIG. 2, may have vertically spaced apart positioning holes 36, and a lock hole 40 at the lower and/or upper end of the tube.

Figure 2:
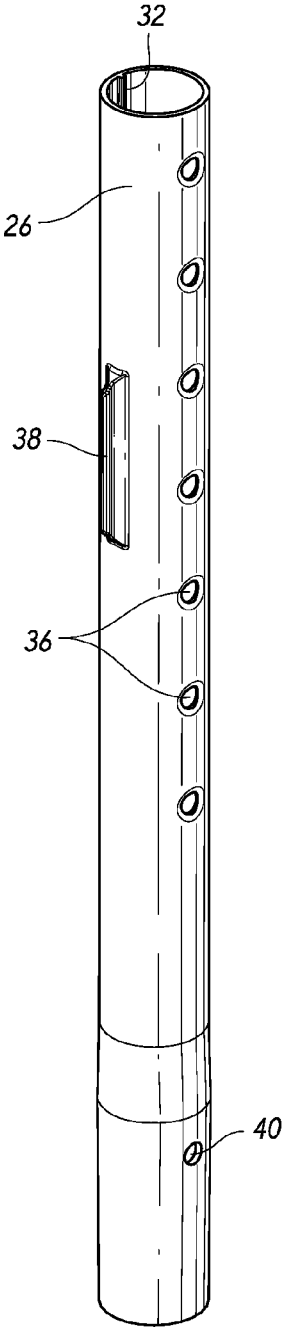
FIG. 2 is a perspective view of the lower tube of the batting tee shown in FIG. 1.
Figure 3:
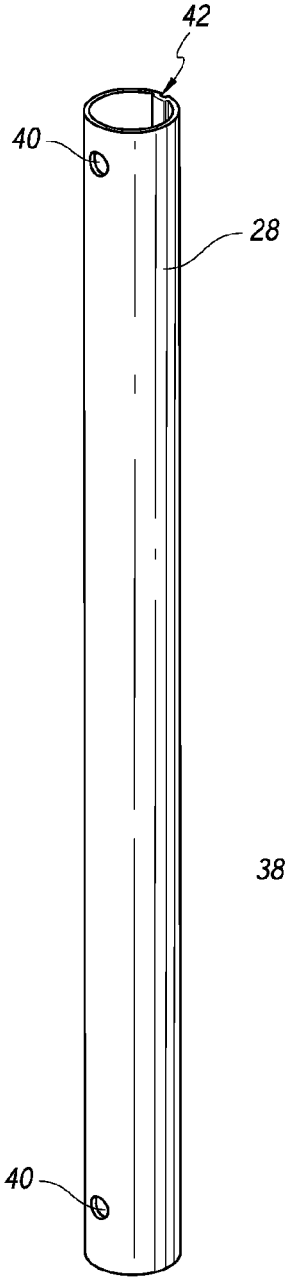
FIG. 3 is a perspective view of the middle tube of the batting tee shown in FIG. 1.
Figure 4:
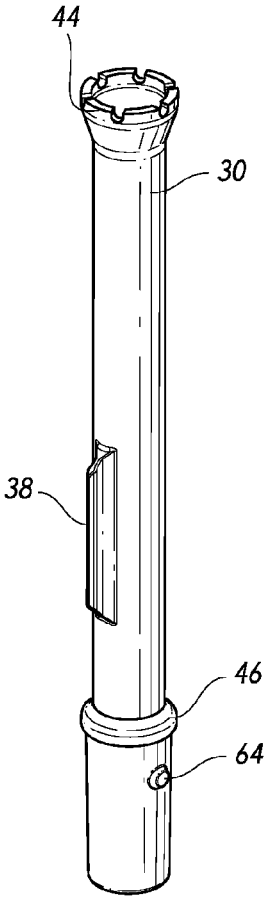
FIG. 4 is an enlarged perspective view of the upper tube of the batting tee shown in FIG. 1.

As shown in FIGS. 2 and 3, an inner rail or lip 32 in the lower tube 26 may project into a groove 42 in the middle tube 28, to maintain radial alignment between the tubes and/or to help guide telescoping movement of the middle tube 28 into and out of the lower tube 26. The lip 32 may extend continuously over the entire length of the lower tube 26, or it may be provided in the form of one or more segments. One or more of the tubes may also have an external rib 38 to provide a visual alignment indicator or a gripping surface.

Although all of the tubes may optionally be telescopically movable, in the specific design shown, the upper tube 30 is insertable by a fixed amount into the upper end of the middle tube 28, with a collar 46 on the upper tube 30 resting on top of the upper end of the middle tube 28. A cup 44 adapted to hold a ball may be provided at the top end of they upper tube 30. The upper tube 30 may be provided as a flexible rubber or plastic tube or rod, to better avoid damage when struck by a bat. The lower and middle tubes, and any additional tubes used, may optionally be more rigid, for example in the form of plastic tubes.

Figure 11:
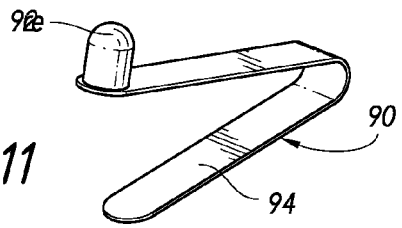
FIG. 11 is a perspective view of a spring lock.

Referring momentarily to FIG. 11, a spring lock 90 may be provided at the lower end of the middle tube 28 for use in locking the middle tube in a fixed position relative to the lower tube 26. If used, the spring lock 90 may have a leg 94 attached to an inner wall of the lower end of the middle tube 28, and a button 92 on a lever positioned to project through a lock hole 40 at the lower end of the middle tube and into one of the positioning holes 36 in the lower tube.

Figure 5:
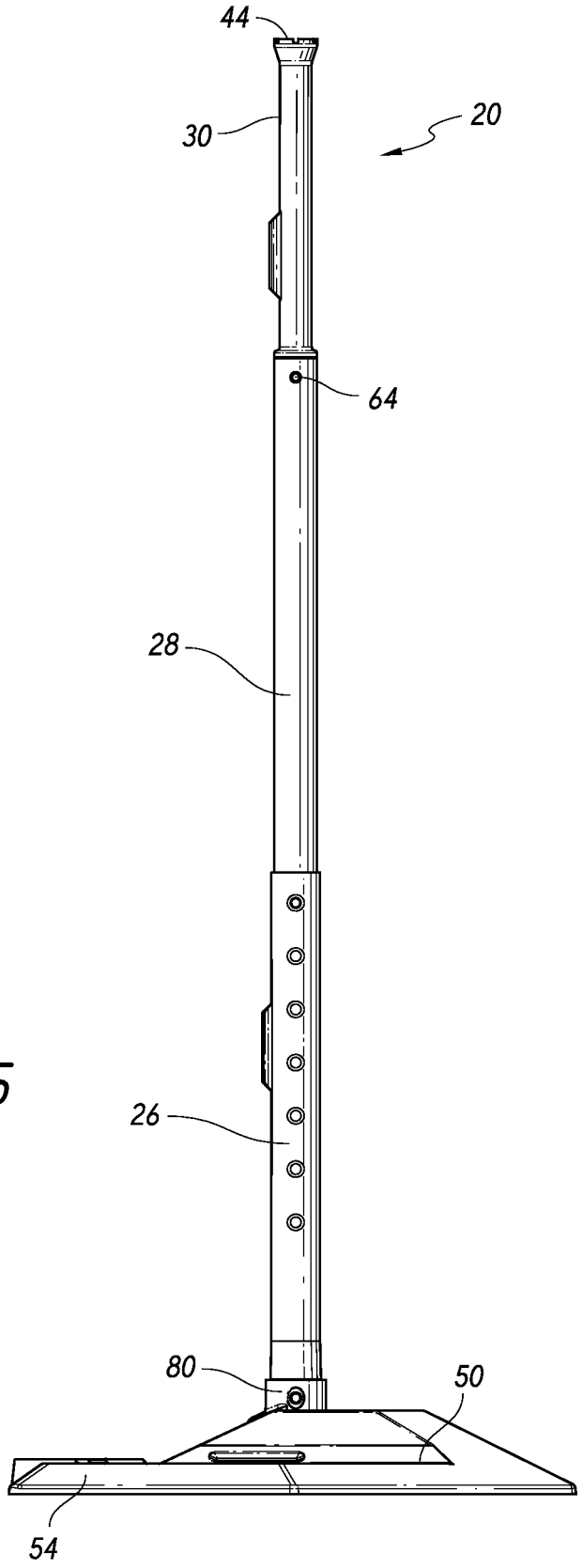
FIG. 5 is a left side view of the batting tee shown in FIG. 1.
Figure 6:
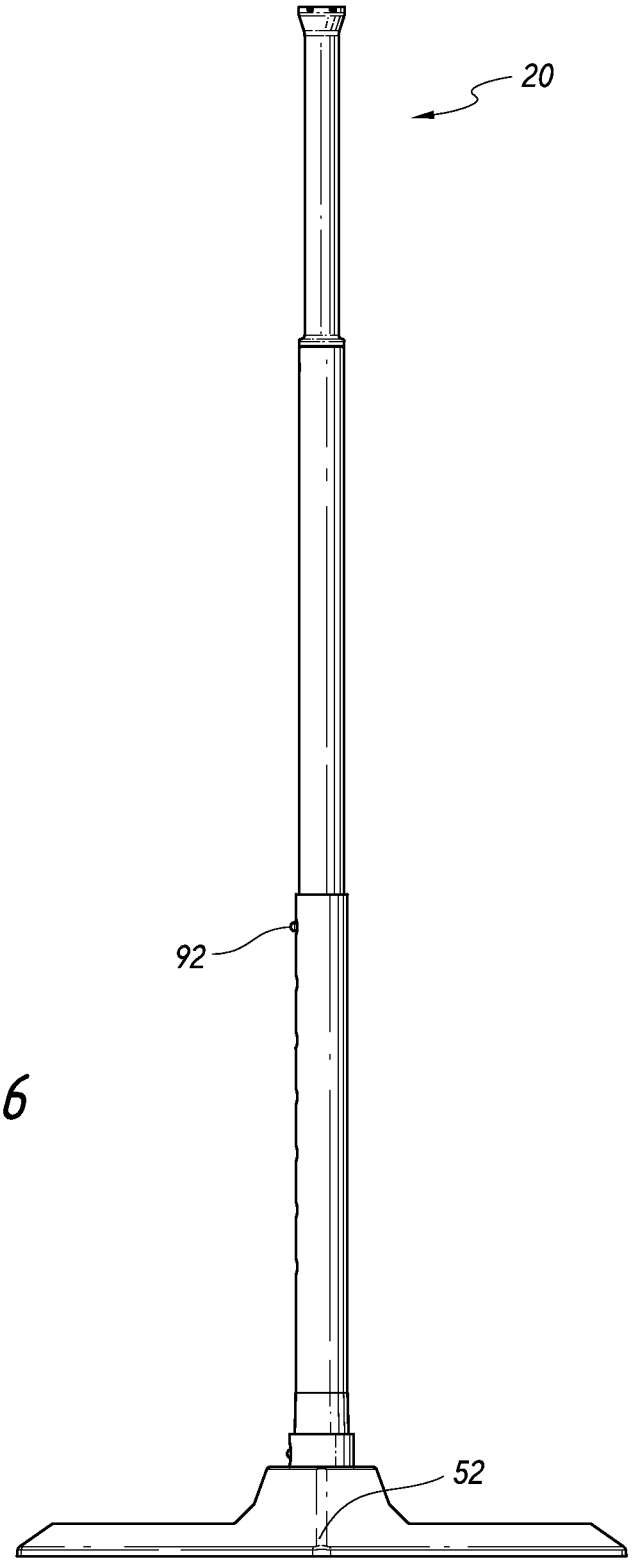
FIG. 6 is a rear view of the batting tee shown in FIG. 1.

FIGS. 5 and 6 shown side and back views of the tee 20 in a fully extended position, with the cup 44 about 28 to 34 inches above the ground. Typically, the lower and middle tubes may be about 10-14 inches long. The lower tube 26 may have an outer diameter generally ranging from about 1 to 1½ inches, with the middle tube 28 having an outside diameter nominally smaller than the inside diameter of the lower tube 26, to allow the middle tube to telescopically slide in and out of the lower tube 30. Although hollow thin-wall round tubes are shown, tubes having other cross sectional shapes, such as hexagonal or octagonal, etc. may also be used.

Figure 7:
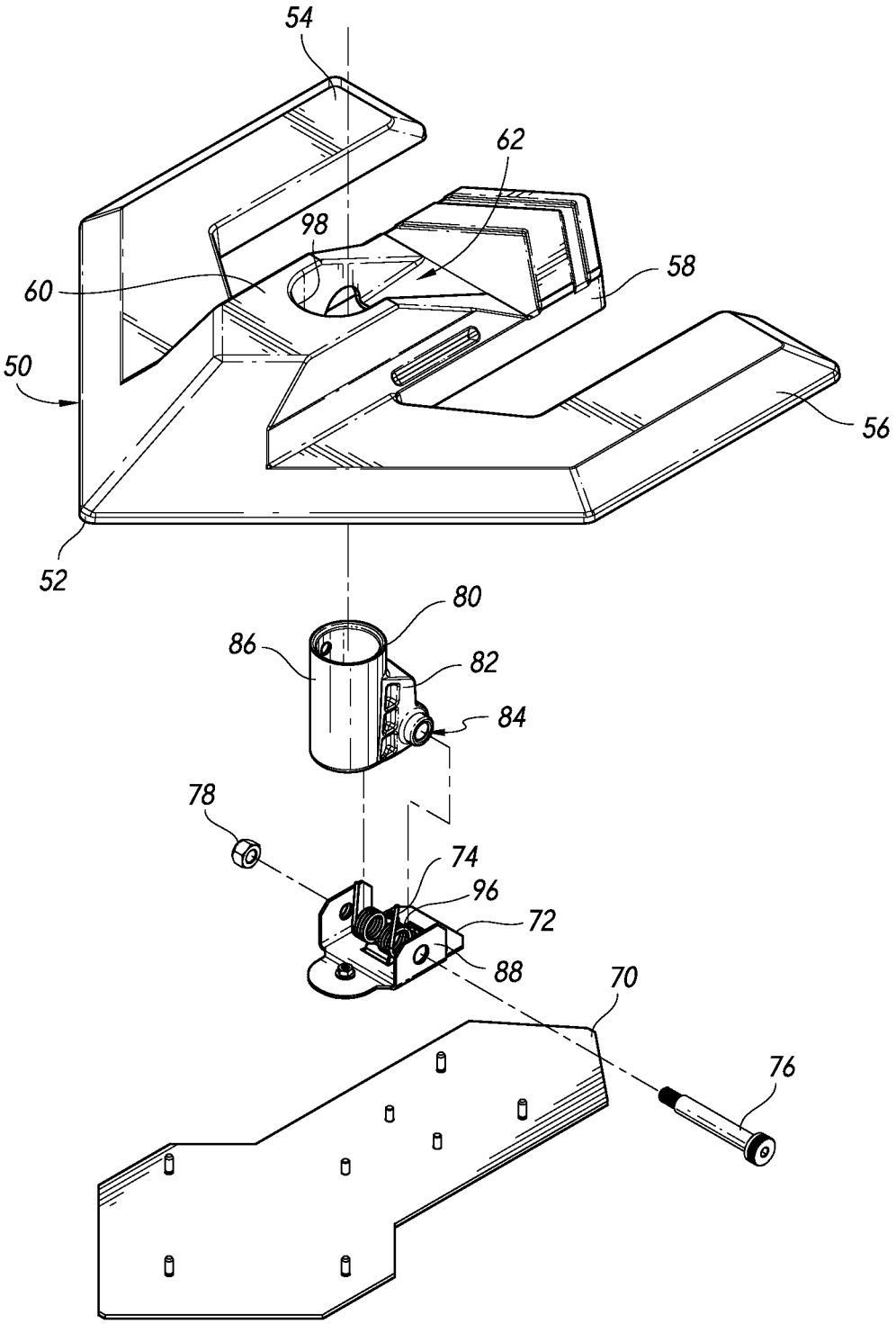
FIG. 7 is an exploded perspective view of the base assembly shown in FIG. 1.

Turning now to FIGS. 7 and 8, the base assembly 22 may have a base 50 having an angled back end 52 and a forward extending left and right arms 54 and 56 on opposite sides of a center arm 58. In FIG. 8 dimension CC may be from about 1.5 to 2.5 or 1.8 to 2.2 times greater than dimension BB, with BB typically ranging from about 5-9 or 6-8 inches. Dimension DD may be up to about 10 or 20% more or less than dimension CC. Angle EE typically ranges from 80 to 100 or 85 to 95 degrees. Dimension BB may be 2 to 4 times greater than dimension AA. As shown in FIG. 8, the base 50 may also be symmetrical about its longitudinal (front to back) centerline. Each of the arms 54, 56 and 58 may extend forward to a common line HH, with the left and right arms having flat front ends and the center arm having an angled front end, optionally matching the angle EE. The spacing JJ between the arms is typically 0.6 to 1.5 or 0.8 to 1.2 times AA.

In FIG. 10, dimension FF which is the height of the raised area 60, may generally range from 1.5 to 2.5 or 3 inches, with dimension GG representing the height of the legs 54 and 56 equal to about 0.4 to 0.6 times FF. The base 50 may be an integrally molded plastic or rubber unit.

A spring biased post holder is attached to the base 50. In this way, when the post assembly 24 is struck by a bat and deflected forward, the post assembly can pivot forwardly relative to the base 50, to better absorb the impact. A spring acting between the post assembly 24 and the base assembly 22 acts to decelerate the forward pivoting movement of the post assembly 24, and then return the post assembly back to the upright position.

Various forms of spring biased post holders may be used, with FIG. 7 showing one example. In FIG. 7, a spring bracket 72 is attached to a base plate 70. An axle 76 extends through holes in side arms 88 of the spring bracket 72, through one or more coil or torsion springs 74 and through an axle hole 84 in an axle housing 82 on or attached to a sleeve or receptacle 86. The axle housing 82 and the sleeve 86 may be integrally joined or formed together to provide a post cup 80. The axle 76 may optionally be a bolt secured with a nut 78. The sleeve 86 is designed to allow the lower end of the post assembly to slidably engage into or onto the sleeve. For example, the sleeve 86 may have an inner diameter nominally larger than the outer diameter of the lower end of the lower tube.

The spring 74 applies torque tending to rotate the post cup 80 counterclockwise in FIG. 7. The post cup 80 is held in the vertical upright position shown in FIG. 1 via the back surface of the sleeve 86 resting against curved vertical wall 98 of the raised area 60, which acts as a hard stop. The base 50 is attached to the base plate 70 e.g., using fasteners, to form the base assembly 22. Referring momentarily to FIG. 8, the centerline of the axle 76 is closer to the front end of the base 50 than to the back end. Or stated differently, the dimension between the centerline of the axle 76 and line HH in FIG. 8 is 5-30 or 10-25% less than dimension BB.

In use, the tee 20 may be provided in a compact form with the post assembly 24 separated from the base assembly 22, and with the tubes of the post assembly separated from each other. The unassembled tee 20 can then be conveniently stored or carried in a bag or other container. The tee 20 can be quickly set up for use by attaching the tubes together to form the post assembly 23. The upper tube 30 may be inserted into the middle tube 28 with the collar 46 coming to rest on the upper end of the middle tube 28. A protrusion 64 below the collar 46 may project through a locking hole 40 at the upper end of the middle tube 28, to better secure the upper tube 30 onto the middle tube 28. Alternatively, the spring lock 90 shown in FIG. 11 may also be used for this purpose.

The middle tube 28 is similarly attached to the lower tube 26 by aligning the lip 32 and the groove 42, if used, and sliding the lower end of the middle tube into the upper open end of the lower tube 26. The height of the post assembly 24 may be adjusted by sliding the middle tube 28 into the lower tube 26 until the button 92 is aligned with and projects into a desired positioning hole 36. The assembled post assembly 24 may then be attached to the base assembly 22 by inserting the lower end of the lower tube 26 into the sleeve 86 of the post cup 80, to provide the fully assembly tee 20 as shown in FIG. 1.

Figure 12:
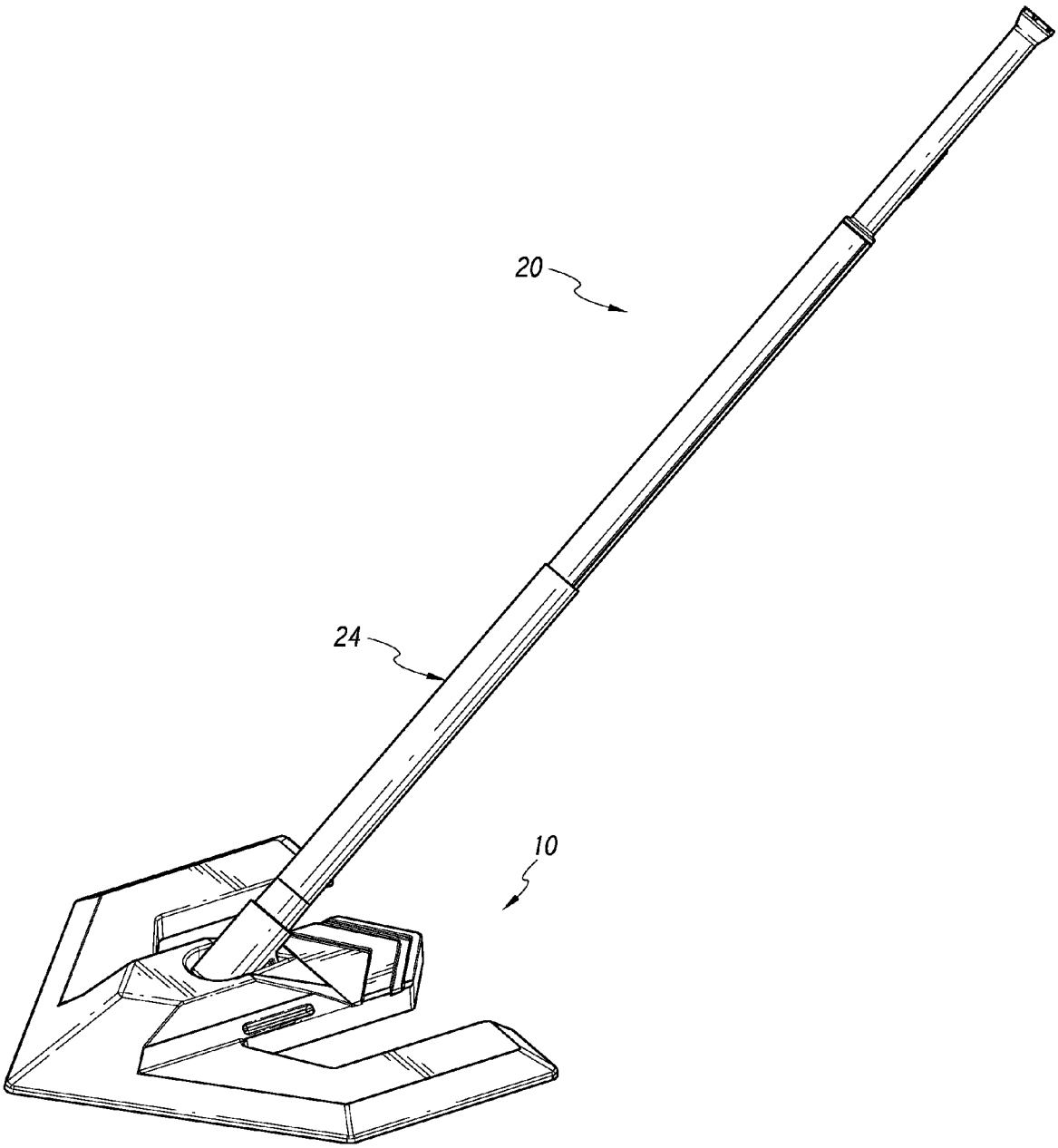
FIG. 12 is a perspective view of the batting tee of FIG. 1 with the post assembly in a deflected position.

The user places a ball on the cup 44 or other feature at the top of the tee. The user can then practice batting by swinging a bat at the ball. If the user swings correctly, the ball is centrally hit, with the bat making little or no contact with the tee. If the user swings low, the bat hits the tee and deflects the post assembly 24 forward, as shown in FIG. 12. The post assembly and the post cup 80 rotate (clockwise in FIG. 1) about the axle 76. The spring 74 exerts torque on the post cup 80 which decelerates this forward rotation and then returns the post assembly 24 back to its upright position. The tee is then ready for further use without the need for the user to reset the tee.

Thus, a novel batting tee has been shown and described. Various changes and substitutions can of course be made without departing from the spirit and scope of the invention. For example, various other types of springs may be used, including linear tension or compression springs, rather than torsion springs. Elastic elements such as elastic bands may also be used to exert a continuous return force on the post cup 80. The base 50 may also optionally be shaped as a traditional home plate, rather than having separate arms as shown in FIG. 8. The invention, therefore, should not be limited except to the following claims, and their equivalents.

The invention claimed is:

1. A batting tee comprising:

a base assembly including a base, a post cup pivotally attached to the base, a base plate, a spring bracket attached to the base plate, and an axle extending through the spring bracket, through the spring, and through an axle hole in the post cup;

at least one spring biasing the post cup into an upright position; and a post assembly having a lower end inserted into the post cup.

2. The batting tee of claim 1 with the base having an angled back end and two or more forwardly extending spaced apart arms.

3. The batting tee of claim 1 with the post cup including a sleeve attached to an axle housing, and with the axle hole extending through the axle housing, and with the lower end of the post assembly inserted into the sleeve.

4. The batting tee of claim 1 with the post assembly including a first tube and a second tube telescopically inserted into the first tube.

5. The batting tee of claim 4 further comprising a plurality of spaced apart positioning holes in at least one of the first tube and the second tube.

6. The batting tee of claim 4 further comprising a third tube inserted into the second tube, and with the lower end of the first tube inserted into the post cup.

7. The batting tee of claim 6 further comprising a ball cup at an upper end of the third tube.

8. The batting tee of claim 4 further comprising a lip on the first tube extending into a groove on the second tube.

9. The batting tee of claim 1 with the spring bracket positioned in a post slot in the base.

10. The batting tee of claim 1 with the spring holding the post cup into contact with a curved vertical wall on the base.

11. A batting tee comprising:

a base plate;

a spring bracket attached to the base plate;

an axle extending through the spring bracket, through a spring, and through an axle hole in an axle housing on the post cup, to pivotally attach a to the post cup onto the base plate, with the spring acting to hold the post cup into an upright position; and a post assembly including at least a first tube attached to a second tube, with a lower end of the first tube inserted into a sleeve on the post cup.

12. The batting tee of claim 11 further comprising a base attached to the base plate, and with the sleeve positioned in a post slot in a raised area of the base.

13. The batting tee of claim 11 further including a spring lock on the second tube having a button projecting through a positioning hole in the first tube.

* * * * *